US007581600B1

(12) United States Patent
Dimitroff

(10) Patent No.: US 7,581,600 B1
(45) Date of Patent: Sep. 1, 2009

(54) METHOD OF FORMING A TRENCHLESS FLOWLINE

(76) Inventor: Ted R. Dimitroff, 7850 E. Highway AB, Columbia, MO (US) 65201

( * ) Notice: Subject to any disclaimer, the term of this patent is extended or adjusted under 35 U.S.C. 154(b) by 288 days.

(21) Appl. No.: 11/422,369

(22) Filed: Jun. 6, 2006

(51) Int. Cl.
*E21B 7/00* (2006.01)

(52) U.S. Cl. ..... 175/62; 175/220; 405/174; 405/184

(58) Field of Classification Search ..... 175/45, 175/53, 61, 62, 202, 220; 405/180, 181, 405/184, 184.4, 174, 184.1–184.3
See application file for complete search history.

(56) References Cited

U.S. PATENT DOCUMENTS 2,027,063 A * 1/1936 Reifel ..... 175/218
4,546,835 A * 10/1985 Williamson et al. ..... 175/40
6,732,816 B2 5/2004 Dimitroff
2003/0152428 A1 * 8/2003 Wentworth et al. ..... 405/184.2

* cited by examiner

*Primary Examiner*—David J Bagnell
*Assistant Examiner*—David Andrews
(74) *Attorney, Agent, or Firm*—McKee, Voorhees & Sease, P.L.C.

(57) ABSTRACT

An improved method of forming a trenchless flow line is provided. The method includes support of the boring tool at each sight relief hole using a hook extending downwardly into the hole so as to overcome the force of gravity on the tool during the pilot hole drilling step. Then, a back reaming tool is connected to the end of the boring tool, and the pipe is connected to the reaming tool, such that the reaming tool reams the pilot hole to a larger diameter ahead of the pipe, which is pulled through the hole with the reaming tool. Drilling fluid is supplied during the reaming process to form a slurry which is pushed ahead of the pipe and upwardly into the sight relief holes, as the pipe is pulled through the reamed hole.

11 Claims, 1 Drawing Sheet

METHOD OF FORMING A TRENCHLESS FLOWLINE

BACKGROUND OF THE INVENTION

Underground utilities, such as storm sewers and other fluid lines, require a flow line to be bored in the ground beneath the surface. Accuracy in the boring process is essential for proper flow through the line. Various methods have been utilized for boring the flow line and installing the pipes therein. These methods include open digging or trenching, tunneling and auger boring, and directional drilling. Each of these methods of boring the flow line has problems and limitations.

For example, open digging presents hazards for workers in the trench. Also, the large size of the trench created by open digging requires extensive time to dig and refill. Furthermore, the pipe in the trench must be backfilled with gravel or similar material to keep the pipe in place. The equipment used in tunneling is complex and expensive, and typically not cost effective for bores having a diameter of less than two to three feet. The tunnel equipment is also bulky and heavy. The pipes used in the tunnels are also expensive. Auger boring lacks guidance, and therefore presents difficulty in creating the proper grade and line. Also, the pipe in both tunneling and auger boring is installed within the bore by a jacking process, and thus must have sufficient strength to withstand the jacking forces. In both tunneling and auger boring, it is sometimes necessary to provide a carrier pipe within a larger pipe to prevent corrosion and provide proper grade.

The directional drilling process eliminates many of the problems associated with open trenching, tunneling and augering, but also has drawbacks, such as lack of accuracy in the electronic tracking components so as to provide proper line and grade for the flow line. Also, the pipes are subjected to substantial pressure from the slurry in the bored hole, and the pipe can float or deflect if the bored hole is too large.

Therefore, a primary objective of the present invention is the provision of an improved method of forming a trenchless flow line using directional drilling.

Another objective of the present invention is the provision of a method of pilot stem control during directional drilling of a flow line.

A further objective of the present invention is the provision of an improved method of back reaming a directionally drilled bore for a flow line.

Still another objective of the present invention is the provision of a method of supporting the boring tool during drilling so as to overcome gravity drop of the tool in vertical sight relief holes.

Another objective of the present invention is the provision of a method of forming a flow line using a minimum of steps.

A further objective of the present invention is the provision of a method of forming a flow line using directional drilling having close tolerance between the bore and the pipe.

Still another objective of the present invention is the provision of a method of forming a flow line using directional drilling wherein the slurry in the bored hole is pushed ahead of the pipe and is forced into vertical sight relief holes as the pipe is pulled through the bored hole.

Yet another objective of the present invention is the provision of an improved method of forming a trenchless flow line which is accurate and cost effective.

These and other objectives will become apparent from the following description of the invention.

BRIEF SUMMARY OF THE INVENTION

The improved method of directionally drilling a flow line involves the initial steps of making a series of substantially vertical sight relief holes, and then drilling a pilot hole in a first direction to each of the sight relief holes using a boring tool on a directional drilling machine. One aspect of the present invention is supporting the boring tool at each of the sight relief holes using a hook extending into the hole so as to overcome the force of gravity on the tool. The method also includes the step of back reaming the pilot hole in a second direction opposite the first direction using a back reaming tool so as to enlarge the diameter of the pilot hole. Another aspect of the present invention is attaching the flow line pipe to the reaming tool and pulling the tool and pipe together in the second direction through the enlarged hole in a single step, thereby eliminating two steps in the known, prior art directional drilling process. Liquid is supplied during the reaming step to form a slurry in the enlarged hole, with the slurry being forced ahead of the pipe and into the sight relief holes as the pipe is moved through the enlarged hole.

DETAILED DESCRIPTION OF THE PREFERRED EMBODIMENT

Figure 2:
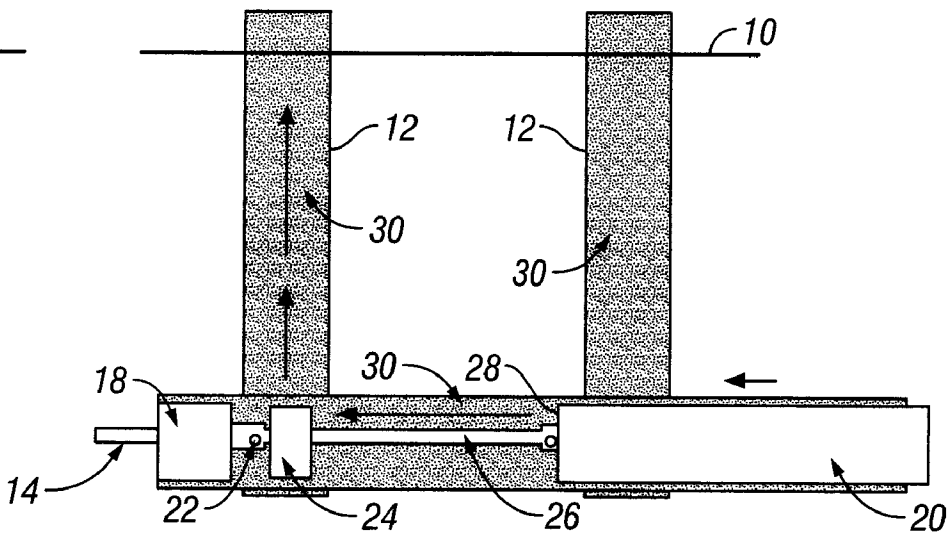
FIG. 2 is a schematic view of a second aspect of the present invention wherein the back reaming tool and pipe are pulled through the reamed flow line hole together, in one step.
Figure 1:
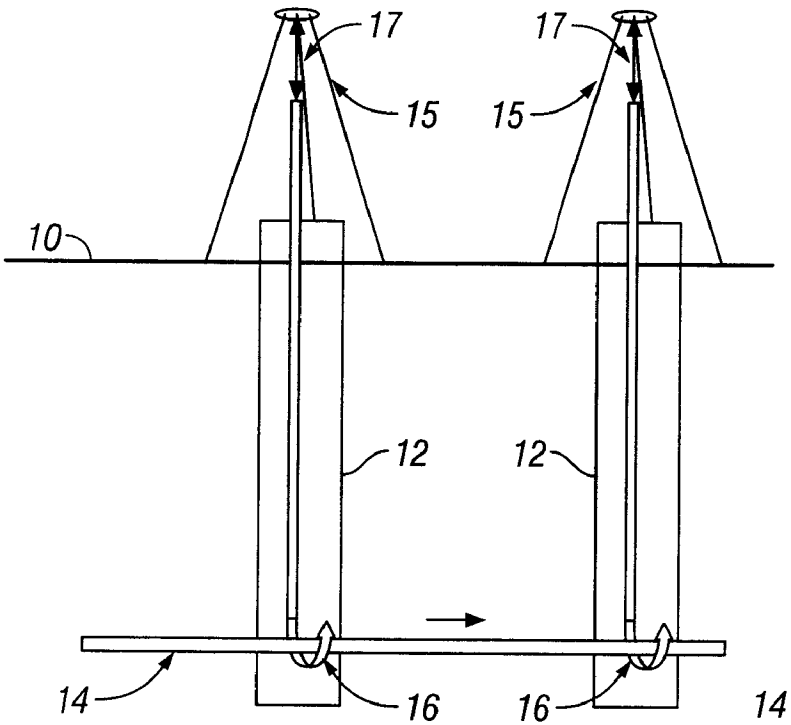
FIG. 1 is a schematic view of the first aspect of the improved method of the present invention wherein the pilot stem is supported by hooks extending downwardly in the vertical sight relief holes.

With reference to the drawings, the ground surface is generally designated by the reference numeral 10. Multiple sight relief holes 12 are drilled substantially vertically in the ground to a distance slightly below the grade or level of the flow line pipe to be installed. A pilot stem or boring tool 14 of a directional boring machine located on the surface 10 creates a pilot hole under the surface 10 of the ground. As the pilot stem 14 reaches each sight relief hole 12, the depth and line of the bore stem 14 is measured, preferably in the manner described in Applicant's prior U.S. Pat. No. 6,732,816, which is incorporated herein by reference.

The present invention is directed, in part, to a tool or hook 16 extending downwardly in each of the sight relief holes 12 to support and engage the pilot stem 14 as the stem passes through the holes 12. Particularly in soft or sandy soil, there is a tendency for the pilot stem 14 to drop due to the force of gravity as it passes through the hole 12, thereby deflecting from the proper line and grade of the flow line. The hooks 16 overcome the gravitational effect on the pilot stem 14, thereby maintaining the correct line and grade for the pilot hole. The hooks 16 are each support above the ground in any convenient manner, such as by tripods 15. A lifting device 17 is provided on each tripod to allow the vertical position of the hook 16 to be adjusted so as to provide the proper line and grade of the pilot stem 14 through the respective sight holes 12.

After the pilot hole is completed, a reaming tool 18 is connected to the end of the pilot stem 14. The new pipe 20 is connected to the reaming tool 18 via a swivel connector 22, a mud paddle 24, and a connecting rod 26. The pilot stem 14 is then pulled backwardly through the pilot hole, thereby pulling the reaming tool 18 and the pipe 20 through the hole in a single step. The reaming tool 18 enlarges the pilot hole ahead of the pipe 20. As the pilot hole is being reamed by the reaming tool 18, drilling fluids are supplied in a conventional manner, thereby creating a slurry mixture of soil and fluids. The slurry mixture 30 flows in front of and around the pipe 20, as well as upwardly into the vertical sight relief holes 12. This improved method allows the pipe 20 to be installed in a reamed hole that is only ⅛-1 inch larger in diameter than the outside diameter of the pipe 20, no matter what size pipe is being installed. The slurry mixture 30 prevents the pipe 20 from floating within the reamed hole, while the sight relief holes 12 also prevent excessive slurry pressure from damaging the pipe 20 and existing utilities.

The connecting rod 26 will preferably have a length equal to, or slightly greater than, the largest distance between adjacent sight relief holes 12 alone the line. The rod 26 may have one or more sections to get the desired length. Thus, the pipe pulling head 28 may be separated from the reaming tool 18 by a distance of 40 feet or more. The spacing between the pipe pulling head 28 and the reaming tool 18 allows the tool 18 to pass each of the relief holes 12, with the pipe pulling head 28 forcing the slurry 30 ahead of the head 28 and up each relief hole 12. The mud paddle 24 has a plurality of blades which minimize or eliminate rotation of the connecting rod 26, thereby enhancing safety.

By connecting the pipe 20 to the reaming tool 18 and pulling them together through the reamed hole, two steps are eliminated from the prior art process described in Applicant's U.S. Pat. No. 6,732,816. In particular, the pre-reaming and push back steps are not necessary with the present invention. Therefore, the improvements of the present invention provide for drilling of a trenchless flow line with less time and cost.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An method of drilling a flow line below the surface, comprising:

making a series of substantially vertical sight relief holes;

then drilling in a first direction to form a pilot hole to each of the sight relief holes using a boring tool on a directional drilling machine;

reaming the pilot hole in a second direction opposite the first direction using a reaming tool so as to enlarge the diameter of the pilot hole;

attaching a pipe to the boring tool and pulling the tool and pipe together through the enlarged hole;

supporting the boring tool at selected sight relief holes with a support hook extending downwardly into the hole so as to overcome the force of gravity on the tool; and suspending the support hook above the sight relief hole.

2. The method of claim 1 wherein each step is performed without forming a trench.

3. An method of drilling a flow line below the surface, comprising:

making a series of substantially vertical sight relief holes;

then drilling in a first direction to form a pilot hole to each of the sight relief holes using a boring tool on a directional drilling machine;

reaming the pilot hole in a second direction opposite the first direction using a reaming tool so as to enlarge the diameter of the pilot hole;

attaching a pipe to the boring tool and pulling the tool and pipe together through the enlarged hole; and securing a connecting rod between the pipe and the boring tool; and providing a mud paddle to reduce rotation of the connecting rod.

4. The method of claim 3 further comprising supplying liquid during the reaming step to form a slurry in the enlarged hole.

5. The method of claim 3 further forcing a portion of the slurry into the sight relief holes while the pipe is being moved through the enlarged hole.

6. The method of claim 3 further supporting the boring tool at selected sight relief holes with a support hook extending downwardly into the hole so as to overcome the force of gravity on the tool.

7. An method of drilling a flow line below the surface, comprising:

making a substantially vertical hole;

extending a hook into the vertical hole;

drilling in a first direction to form a pilot hole using a boring tool on a directional drilling machine, and the pilot hole intersecting the vertical hole;

supporting the boring tool on the hook;

reaming the pilot hole in a second direction opposite the first direction using a reaming tool so as to enlarge the diameter of the pilot hole;

attaching a pipe to the boring tool and pulling the tool and pipe together through the enlarged hole;

supplying liquid during the reaming step to form a slurry in the enlarged hole;

securing a connecting rod between the pipe and the boring tool; and providing a mud paddle to reduce rotation of the connecting rod.

8. The method of claim 7 further forcing a portion of the slurry into the vertical hole while the pipe is being moved through the enlarged hole.

9. The method of claim 7 further comprising adjusting the elevation of the hook in the vertical hole to achieve a desired line for the pilot hole.

10. The method of claim 7 wherein the vertical hole is made before the pilot hole is drilled.

11. The method of claim 7 wherein each step is performed without forming a trench.

* * * * *

UNITED STATES PATENT AND TRADEMARK OFFICE

CERTIFICATE OF CORRECTION

PATENT NO. : 7,581,600 B1
APPLICATION NO. : 11/422369
DATED : September 1, 2009
INVENTOR(S) : Ted R. Dimitroff It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 375 days.

Signed and Sealed this

Fourteenth Day of September, 2010

David J. Kappos

David J. Kappos
*Director of the United States Patent and Trademark Office*